US006666135B1

(12) United States Patent
Brendel et al.

(10) Patent No.: US 6,666,135 B1
(45) Date of Patent: Dec. 23, 2003

(54) CALENDER

(75) Inventors: Bernhard Brendel, Grefrath (DE); Peter Svenka, Grefrath (DE)

(73) Assignee: Eduard Küsters Maschinenfabrik GmbH & Co. KG, Krefeld (DE)

( * ) Notice: Subject to any disclaimer, the term of this patent is extended or adjusted under 35 U.S.C. 154(b) by 570 days.

(21) Appl. No.: 09/604,837

(22) Filed: Jun. 27, 2000

Related U.S. Application Data

(63) Continuation-in-part of application No. 09/117,753, filed as application No. PCT/EP97/06474 on Nov. 20, 1997, now Pat. No. 6,095,039.

(30) Foreign Application Priority Data

Dec. 6, 1996 (DE) ..... 196 50 576

(51) Int. Cl.[7] ..... D21G 1/00; B30B 3/04

(52) U.S. Cl. ..... 100/47; 100/139; 100/162 B; 100/172

(58) Field of Search ..... 100/217, 161, 100/162 R, 162 B, 163 R, 163 A, 172, 169, 170, 329

(56) References Cited

U.S. PATENT DOCUMENTS

| | | | | |
|---|---|---|---|---|
| 1,793,114 A | * | 2/1931 | Minton | |
| 3,044,392 A | * | 7/1962 | Minarik | |
| 3,172,313 A | * | 3/1965 | Fox | |
| 4,332,191 A | * | 6/1982 | Kankaanpaa | 100/162 R |
| 4,471,690 A | * | 9/1984 | Yamaguchi et al. | 100/162 R |
| 4,823,690 A | * | 4/1989 | Stotz | 100/163 A |
| 5,784,955 A | * | 7/1998 | Conrad | 100/162 R |

FOREIGN PATENT DOCUMENTS

| | | |
|---|---|---|
| CA | 2169978 | 9/1996 |
| CA | 2188607 | 5/1997 |
| DE | 29504034 U | 6/1995 |
| DE | 29518424 U1 | 4/1996 |
| JP | 04-185790 | 7/1992 |

* cited by examiner

*Primary Examiner*—W. Donald Bray
(74) *Attorney, Agent, or Firm*—Townsend and Townsend and Crew, LLP

(57) ABSTRACT

The invention concerns a calender which comprises a vertical stack of interlinked rollers driven individually by regulated electric motors. The regulation process acts on the distribution of the delivered power to the individual rollers such that the forces acting on the rollers in the horizontal direction and measured in the roller bearings are minimized, so enabling slimmer rollers to be used.

7 Claims, 6 Drawing Sheets

CALENDER

CROSS-REFERENCES TO RELATED APPLICATIONS

This application is a continuation-in-part of, and claims the benefit of priority from U.S. application Ser. No. 09/117,753, filed on Mar. 22, 1999 and now U.S. Pat. No. 6,095,039, which is a 371 filing of PCT/EP97/06474, filed Nov. 20, 1997, which is a European PCT filing of German application no. 196 50 576.3, filed Dec. 6, 1996, the full disclosures of which are incorporated herein by reference.

BACKGROUND AND SUMMARY OF THE INVENTION

The invention relates to a calender for treating a product web, in particular a paper web, for example a smoothing calender.

DE-U-295 04 034 discloses a calender for treating a product web, which has a plurality of rolls, of which in each case a hard roll and a resilient roll define a nip, the rolls are arranged in an upright with their respective axes displaceable in a loading plane and the end rolls are deflection controlled rolls. An intermediate roll in the roll stack is driven, in order to move the product web through the calender.

In this conventional concept with a central drive, the drive forces are transmitted by friction with the other rolls and by the product web. As a result, deflections at right angles to the loading plane are caused, as shown in FIG. 1 by way of example for a vertical roll stack. The vertical roll stack defines a vertical loading plane 1, in which the rolls 2 to 6 are displaceable, in order to close the roll stack and to set defined linear loads in the nips defined in each case between two rolls.

The central drive of an intermediate roll 3 transmits a drive torque to the respectively adjacent rolls 2 and 4, which are not equipped with their own drive and for their part transmit a drive torque to the adjacent roll 5 not equipped with a drive, and so on. The transmission of the drive torques leads to deflection forces at right angles to the loading plane, which, according to FIG. 1, act in the horizontal direction. The deflection forces are indicated by way of example for the rolls 4 and 5 by the arrows 7, 8 and lead to the erroneous positions of the rolls 4, 5, said positions consisting of displacements at right angles to the loading plane 1. The correct positions are indicated dashed. These erroneous positions of the 2 rolls result in nonuniform web profiles, overloading of the edges of the rolls and a loss of web strength.

The processes in the nip are explained in detail in the publication Pav/Svenka, Der Kompaktkalander—die Antwort auf die Herausforderung nach hohen Geschwindigkeiten bei der Gl&ttung und Satinage" (The compact calender—the answer to the challenge of high speeds in smoothing and calendering], DAS PAPIER 1985, pp. V178 ff.

In order to avoid erroneous positions of the rolls at right angles to the loading plane, use has been made of rolls with relatively large roll diameters, but without being able to eliminate the disadvantageous erroneous positions completely. In addition, the construction and operation of the calender became complicated as a result of the relatively large roll diameters. Finally, it is disadvantageous that even if the displacement of the rolls at right angles to the loading plane is kept within limits, shear stresses still act on the product web in the nip and, in the case of a product web of paper, can loosen the bonding between the fibers in the web running direction and thereby reduce the strength of the paper.

The object of the invention is therefore to provide a calender which permits non-harmful treatment of the web strength and, at the same time, is cost effective in construction and operation.

This object is achieved by the features of claim 1 or claim 3.

This provides a calender in which the shear stresses acting on the product web are minimized. The rolls can be designed with diameters which are determined by criteria other than their resistance to deformation, for example the critical inherent frequencies.

In particular, rolls with smaller diameters can be used, as a result of which the compressive stress at a given linear load can be increased. Rolls of a smaller diameter also have a lower weight, so that the static (gravitation-induced) forces are low in relative terms and smaller bearings can also be used.

The drives apply the specific power tor the respectively driven roll, this power being composed of re-forming, transporting and loss power. In this case, a distribution of 50:50 to the two nip-forming rolls would be only a rough guide, since, for example, a deflection controlled roll has considerably higher friction losses than a normal solid roll.

The forces which are to be controlled out according to the invention can be measured, for example, in the roll bearings; bearings with force measuring systems incorporated are commercially available. However, it is at least also conceivable to use measurement methods to detect the deflections at right angles to the loading plane that are brought about by such forces.

The invention will be explained in more detail below using the exemplary embodiments illustrated in the appended drawings.

DESCRIPTION OF THE SPECIFIC EMBODIMENTS

Figure 2:
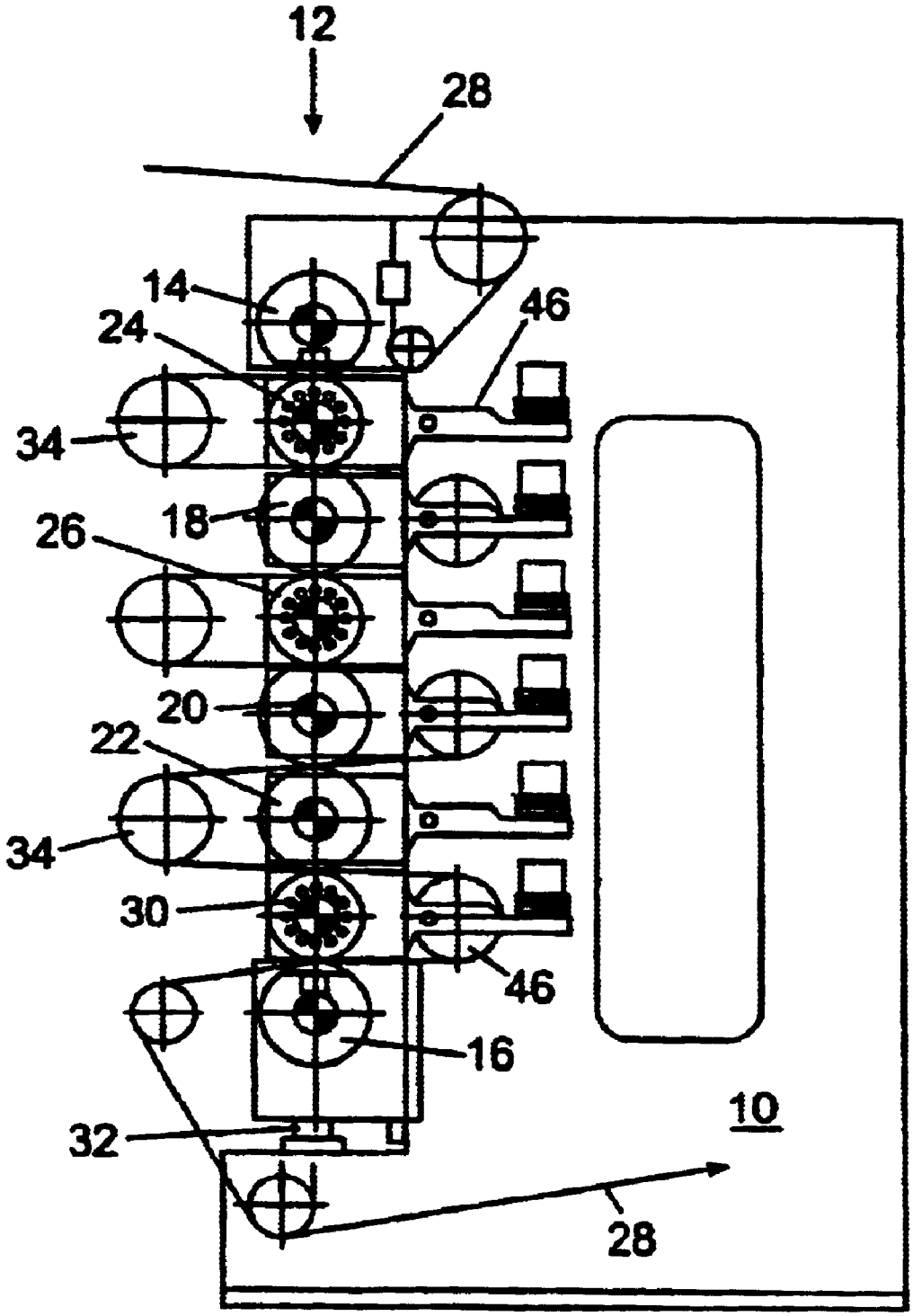
FIG. 2 shows a schematic side view of a first exemplary embodiment of a calender according to the invention.

FIG. 2 shows a calender frame 10 with side uprights, implemented as a welded or cast construction. Arranged in the frame 10 is a calender 12, which has eight nip-forming rolls. The top and the bottom rolls 14 and 16, respectively, the end rolls, are deflection controlled rolls, and the yoke of the upper deflection controlled roll is clamped immovably in the frame; the bearings of this roll are also immovable. The roll 14 is provided with an elastic cover, as are the lower deflection controlled roll 16 and the rolls 18, 20 and 22, which are provided in the calender 12. Arranged between the rolls 14 and 18 is a hard, heatable roll 24, which forms a nip in each case with the rolls 14 and 18 respectively arranged above and below it. In addition, between the rolls 18 and 20 there is a hard, heatable roll 26, which defines a nip with each of these rolls. The nip through which the product web 28 passes between the rolls 20 and 22 is used not only for re-forming the product web but also as a reversing nip, in order to turn that side of the product web that previously faced the resilient rolls towards the hard, heatable roll 30, which is arranged between the rolls 22 and 16. (The relevant side of the product web has already passed through four nips albeit facing a resilient roll in each case, but has nevertheless been smoothed in the process to such an extent that passage through two further nips on the heated side is sufficient).

The bearings of all the rolls, with the exception of the upper deflection controlled roll 14, are arranged in the frame 10 such that they can be displaced by sliding. The loading of the nips is carried out by means of hydraulic cylinders 32 and results, for example, in an average line force of 500 N/mm. It should be noted that the line force can also be applied by means of the deflection controlled rolls. The hard rolls may be heated with steam to, for example, up to 200° C. The resilient rolls may be temperature-controlled. The product web 28 is led between the individual nips around guide rolls 34, whose surfaces are provided with spiral grooves in order to ensure that the product web is kept spread out and to prevent the formation of an air cushion on which the product web could float. Pneumatic compensation of the overhanging loads is carried out by means of compensation units 46, in whose stead hydraulic or other servo drives may also be provided.

Normal spreader rolls may also be provided. The calender arrangement shown can be arranged downstream of a paper or coating machine as an "in-line calender," or can operate as an "off-line calender".

The arrangement described thus far largely corresponds to the prior art of a calender with vertical arrangement of the rolls, apart from the fact that the diameter of the rolls between the deflection controlled rolls, but at least of the hard rolls, is considerably smaller than usual. The loading plane 1 runs in the vertical direction.

According to the first variant of the invention, each nip-forming roll is provided with its own drive, comprising an electric motor, for example a DC motor, which is coupled via a cardan shaft to the roll assigned to it and which is fed from a regulated supply unit. In the figures, the drives are indicated by the usual two-quadrant circle symbol.

Figure 6:
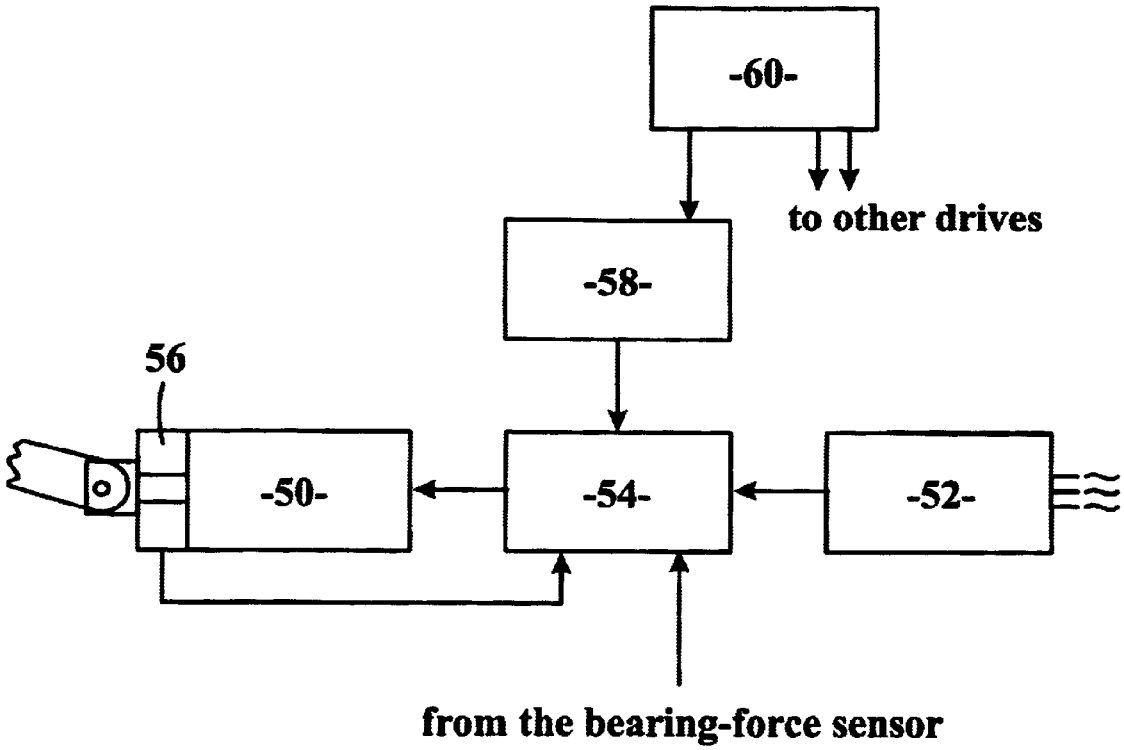
FIG. 6 shows a block diagram of the control of one of the rolls.

FIG. 6 shows the drive of one of the rolls. The drive motor is a DC motor 50, fed from a converter 52 via a controller 54, preferably a digital PID controller.

In the start-up phase, the rotational speed is controlled; for this, each motor 50 has an actual-value transmitter in the form, for example, of a tachogenerator 56; the set points can be stored in an electronic memory 58, which is read out sequentially. In the start-up phase, the set points are selected such 6 that the rolls which in each case define a nip have the same circumferential speed.

In the operating phase, the circumferential speed is a suitable parameter only to a limited extent, since the resilient rolls certainly deform in the region of the nip, that is to say there is no longer strict proportionality between rotational speed and circumferential speed. This is correspondingly true for the expansion which occurs when a roll is heated.

For this reason, power control is carried out during operation, by the drive torques being divided between the adjacent, driven rolls. Each roll is preferably supplied with an amount of power which, at least approximately, covers half the re-forming and transporting power transmitted to the product web in each nip defined by the said roll, plus the loss power. It should be noted that the drive power of the guide rolls 44 in the embodiment illustrated is transmitted by means of the product web in the manner of a flexible drive-gear mechanism; this power therefore also has to be taken into account when calculating the set points—also stored in the memory 56. However, it is preferred, particularly in the case of larger in-line calenders, to provide the guide rolls with their own drives as well.

The power control arrangement has the special feature that, when metering the power to the motors, which each drive pairs of rolls which bound a nip, the power of both motors is adjusted in the event of a setpoint deviation and, since all the rolls are linked to one another, this means a control intervention in all the motors. An overall controller 60 is therefore placed hierarchically above the individual motor controller and in the event of a set-point deviation, even just in the case of a single roll, calculates new set points for the power for all the rolls or takes these set points from a look-up table memory.

Arranged in the bearings of the rolls are force sensors, which sense at least the forces that are 7 transmitted in the horizontal direction from the relevant roll to the frame 10. Such "force measuring bearings" are offered, for example, by SKF Kugellagerfabriken GmbH, Schweinfurt. As mentioned above, the power or, more precisely, the power distribution is controlled in such a way that these horizontal forces are kept as small as possible.

The calender arrangement according to FIG. 2 can be operated in such a way that the number of nips through which the web passes is predefined. Furthermore, the operator is able to influence the technological result by selecting the line load and the roll temperatures.

Figure 3:
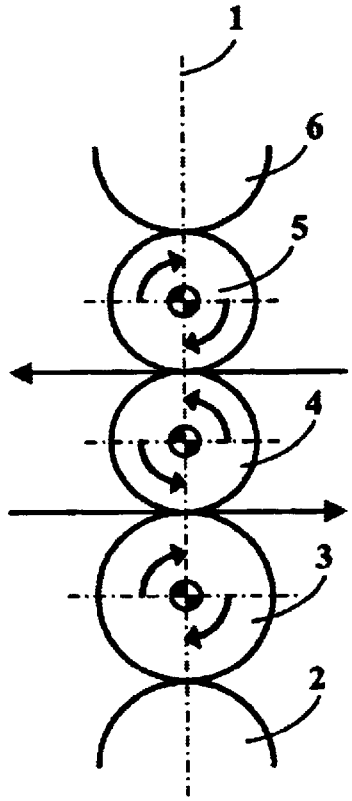
PRIOR ART Fig. 3
FIG. 3 shows a portion of the calender of FIG. 2 with a symbolized indication of the drive forces acting on the product web.

The distribution according to the invention of the drive to the rolls of a calender minimizes displacements of the rolls at right angles to the loading plane 1, as illustrated in FIG. 3. Shear stresses which would have a detrimental effect on the product web are avoided, as shown by the arrows, which point in the running direction of the product web.

Figure 1:
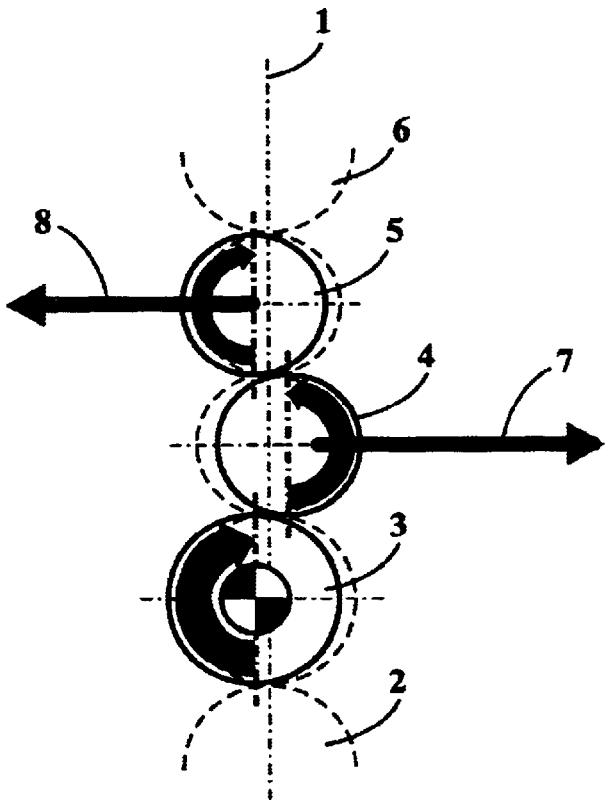
FIG. 1 shows a roll stack with a central drive according to the prior art.
Figure 4:
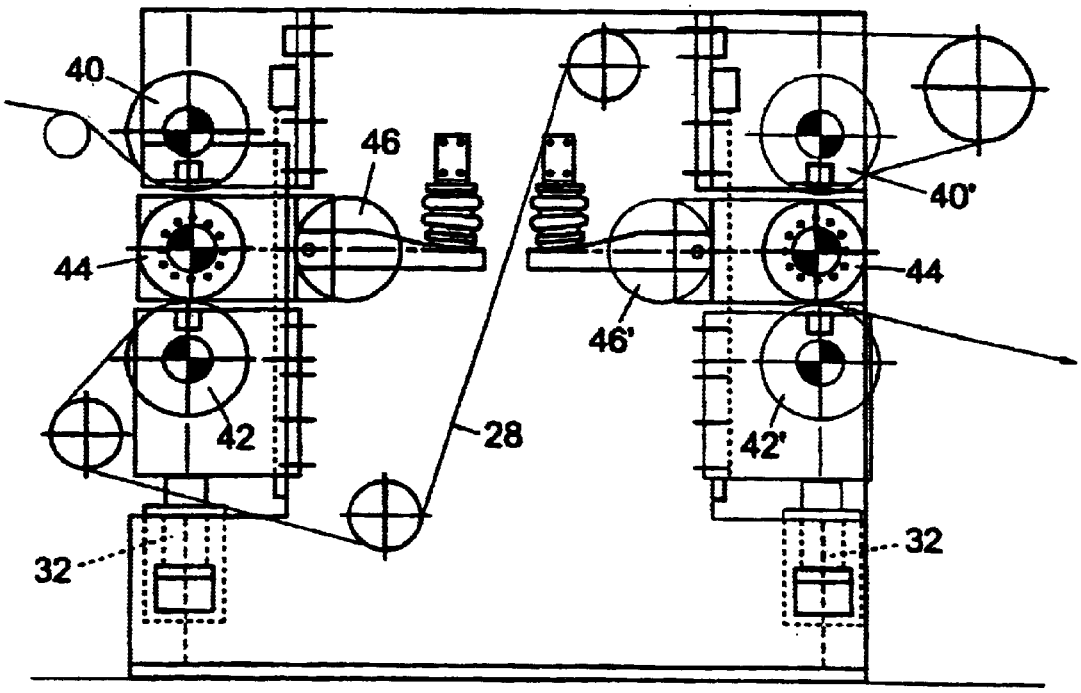
FIG. 4 shows a schematic side view of a second exemplary embodiment of a calender according to the invention.

FIG. 4 shows, as a second embodiment, a double calender having in each case only two nips for calendering one of the product web sides in each case. The elements of the calender on the left in the drawing are designated using the reference symbols of analogous elements in FIG. 1. In the case of the right-hand calender, an index stroke is added in each case. It can be seen that each individual calender also has just two deflection controlled rolls 40 and 42 with an elastic cover, and a hard, heated roll 44 arranged between them.

Figure 5:
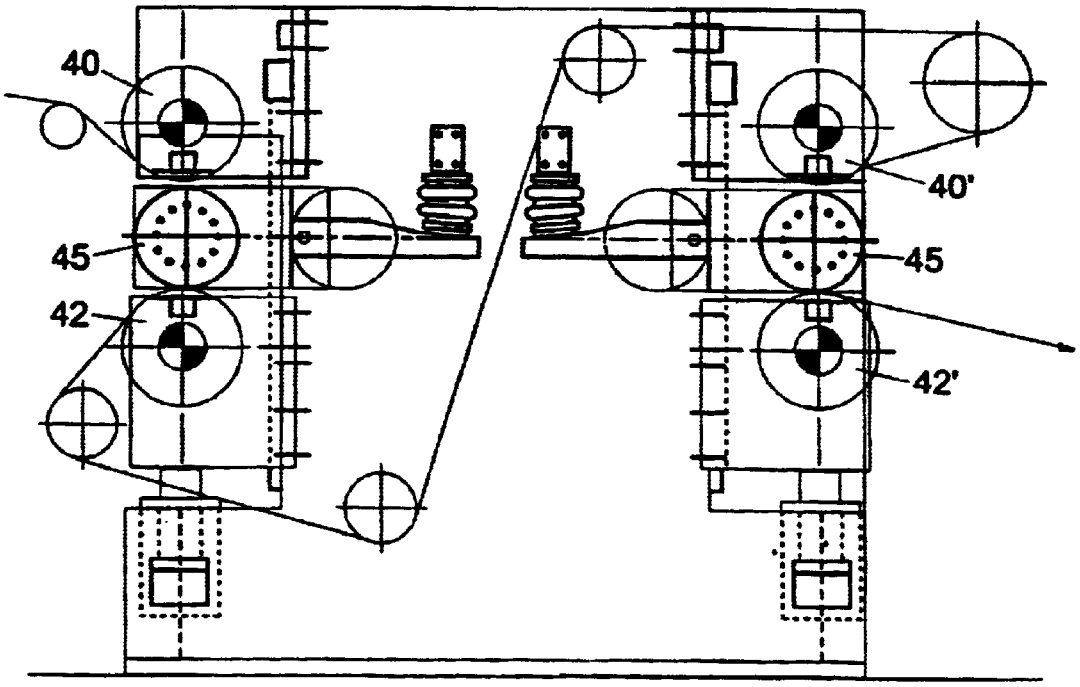
FIG. 5 shows a modification of the second exemplary embodiment.

FIG. 5 illustrates an example of the second variant of the invention, derived from the embodiment according to FIG. 4. Here, the hard, heated, intermediate roll 45 does not have its own drive, but rather is driven along by the covers of the deflection controlled rolls 40, 42. Although the latter transmit the drive torques through the product web to the hard roll 46, the drives of the two resilient rolls are 8 controlled in such a way that the forces acting on the hard roll are equal and opposite.

It is assumed that, for example in the case of smoothing calenders, the extremely high compressive stresses in the nips, in combination with high temperature, mean that good technological results can be achieved even with the configurations illustrated in FIGS. 4 and 5. In addition to such a 3/3 configuration, numerous further configurations in which in each case a hard roll is arranged between two resilient rolls, such as the configurations 5/3, 7/3, 5/5, 8/5 and so on, are conceivable.

Figure 7:
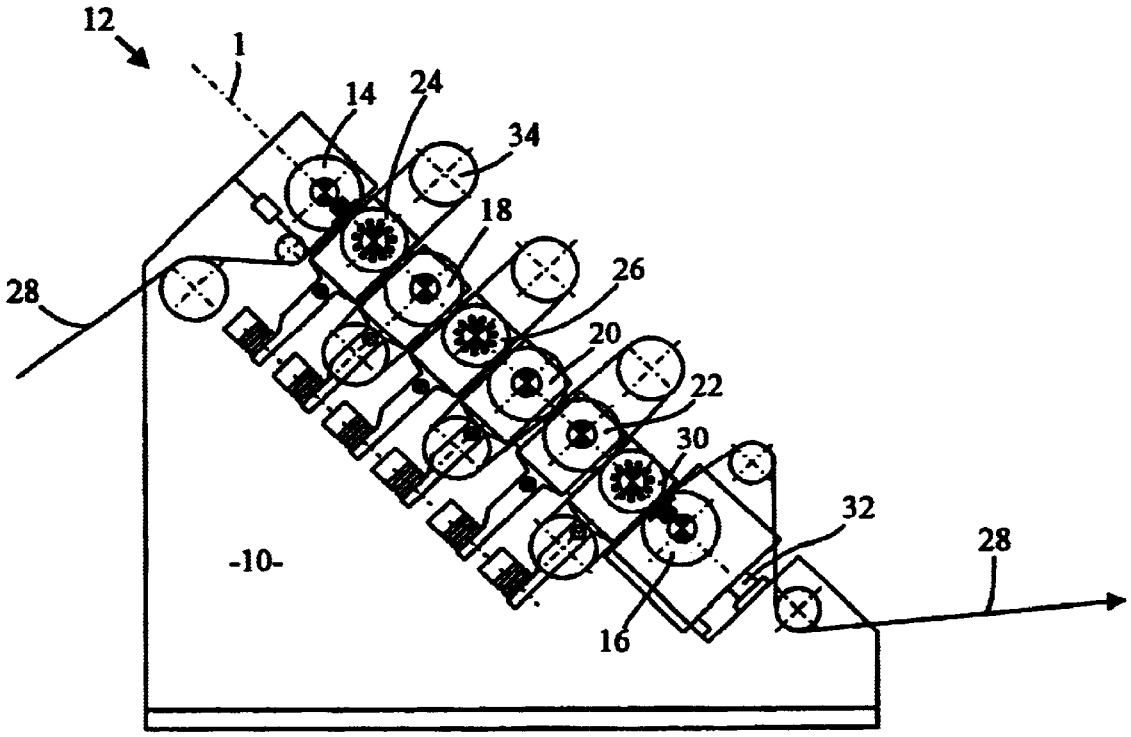
FIG. 7 shows a schematic side view of a third exemplary embodiment of a calender according to the invention.

FIG. 7 shows a fourth exemplary embodiment of a calender according to the invention, which differs from the first exemplary embodiment illustrated in FIG. 2 in that the loading plane runs in at an angle rather than in the vertical direction. The displacement forces acting at right angles to this inclined loading plane are minimized by the configuration according to the invention with individual power drives and control of the drive power of the latter in such a way that the drive torques transmitted by the rolls are kept to a minimum. Otherwise, the explanations relating to the first exemplary embodiment apply in a corresponding way here.

Figure 8:
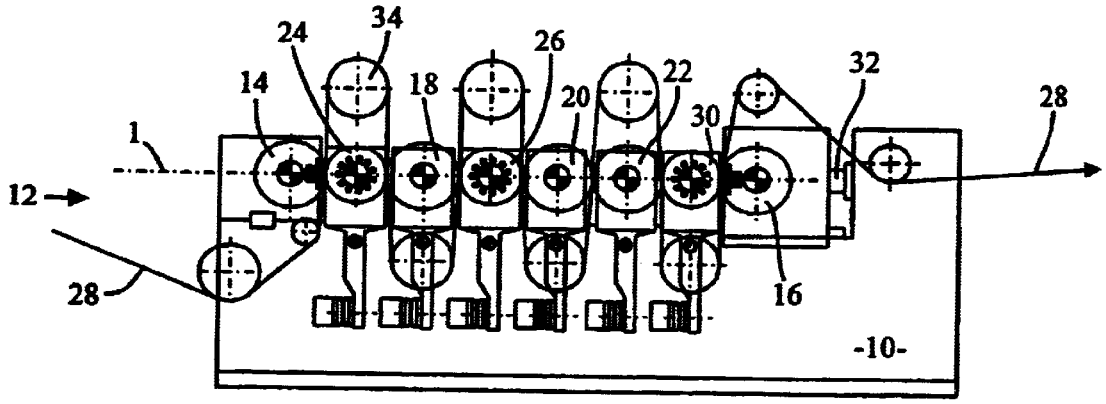
FIG. 8 shows a schematic side view of a fourth exemplary embodiment of a calender according to the invention.

The same applies to the exemplary embodiment shown in FIG. 8 of a calender with a loading plane 1 which runs in the horizontal direction, so that the displacement forces acting at right angles thereto act vertically here.

Although the invention has been described in some detail by way of illustration and example, for purposes of clarity and understanding, it will be obvious that certain changes and modifications may be practiced within the scope of the invention.

What is claimed is:

1. A calender for treating a product web, said calender comprising:

a plurality of rolls having horizontal axes including at least a hard roll, a resilient roll, and a pair of end rolls which together define a treating nip, wherein the horizontal axes are displaceable in a loading plane and wherein end rolls are deflection controlled; and a drive for each roll in the treating nip so that the drive torque transmitted from each roll to adjacent roll(s) are minimized.

2. A calender as in claim 1, further comprising an additional drive coupled to each roll.

3. A calender for treating a product web, said calender comprising:

a plurality of rolls having horizontal axes including at least a hard roll, a resilient roll, and a pair of end rolls which together define a treating nip, wherein the horizontal axes are displaceable in a loading plane and wherein end rolls are deflection controlled; and a plurality of drives, wherein some but not all of the rolls are connected to a drive;

wherein at least one roll is not connected to a drive and is arranged between the driven rolls and wherein the drives connected to the driver rolls are controlled in such a way that the drive torques transmitted to the non-driven rolls(s) minimize the displacement of the non-driven roll(s) at right angles to the loading plane.

4. A calender as in claim 1 or 3, further comprising a drive power supply which divides power between at least two driven rolls adjacent to a non-driver roll.

5. A calender as in claim 4, wherein the drive power supply divides power equally between to the two driver rolls.

6. A calender as in claim 4, wherein the drive power supply supplies power to the driver rolls in a controlled manner so that one roll receives power to treat the web and the other roll receives power to reform the web.

7. A calender as in claim 4, further comprising means for measuring actual roll bearing forces at right angles to the loading plane.

* * * * *